US006791247B1

(12) United States Patent
Takahashi

(10) Patent No.: US 6,791,247 B1
(45) Date of Patent: Sep. 14, 2004

(54) LAMP

(75) Inventor: Toshio Takahashi, Kobunakoshi (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 165 days.

(21) Appl. No.: 09/890,200

(22) PCT Filed: Nov. 21, 2000

(86) PCT No.: PCT/EP00/11695

§ 371 (c)(1),
(2), (4) Date: Jul. 26, 2001

(87) PCT Pub. No.: WO01/43164

PCT Pub. Date: Jun. 14, 2001

(30) Foreign Application Priority Data

Nov. 26, 1999 (JP) ..... 11/335571

(51) Int. Cl.[7] ..... H01J 1/88; H01J 19/42
(52) U.S. Cl. ..... 313/271; 313/273; 313/277
(58) Field of Search ..... 313/271–274, 313/578–580, 220, 222, 631–632, 277–279, 623

(56) References Cited

U.S. PATENT DOCUMENTS 3,555,338 A * 1/1971 Scoledge et al. ..... 313/113
3,622,832 A * 11/1971 Schlessel et al. ..... 313/318.11
3,909,653 A * 9/1975 Bottone et al. ..... 313/271
3,986,067 A * 10/1976 De Fraeye ..... 313/273
4,145,630 A * 3/1979 DeCaro et al. ..... 313/273
4,311,940 A * 1/1982 Fitzgerald et al. ..... 313/273
4,317,060 A * 2/1982 Fitzgerald et al. ..... 313/113
4,366,411 A * 12/1982 Robinson ..... 313/272
4,553,066 A * 11/1985 Fields et al. ..... 313/580
4,658,180 A * 4/1987 Ooms ..... 313/273
4,823,048 A * 4/1989 Ooms ..... 313/623
5,900,696 A * 5/1999 Buschmann et al. ..... 313/578

* cited by examiner

*Primary Examiner*—Nimeshkumar D. Patel
*Assistant Examiner*—Dalei Dong
(74) *Attorney, Agent, or Firm*—Ernestine C. Bartlett

(57) ABSTRACT

The lamp of the invention has three lead rods (6, 7, 8) and two filament structure bodies (13). Each of the two filament structure bodies has three filaments (13*a*, 13*b*, 13*c*). All the filaments (13*a*, 13*b*, 13*c*) are arranged around the outside of the three lead rods (6, 7, 8). Since light from each of the filaments (13*a*, 13*b*, 13*c*) reaches outside of the lamp (1) without the light travel being hindered by the three rods (6, 7, 8), the light from the filaments (13*a*, 13*b*, 13*c*) is uniformly radiated.

7 Claims, 6 Drawing Sheets

LAMP

BACKGROUND OF THE INVENTION

This invention relates to a lamp comprising at least one lead rod and a plurality of filaments.

SUMMARY OF THE INVENTION

Heretofore, spotlighting at a studio and a stage or the like has been performed by combining a halogen lamp with a reflector in general. FIG. 9 is a view showing a conventional example of a halogen lamp for the studio. This halogen lamp 100 comprises a base 101 and a glass tube 102 is provided on the upper of this base 101. Two pieces of lead rod 105 fixed by two pieces of glass piece 103 and 104 are arranged on the inside of the glass tube 102. The glass piece 103 fixes the upper end of two pieces of lead rod 105 and another glass piece 104 fixes the central portion of two pieces of lead rod 105. Moreover, a plurality of filaments 106 connected to each other in series is arranged between the glass pieces 103 and 104. These plurality of filaments 106 are supported by a support 108, and both ends 106*a* of these plurality of filaments 106 connected each other in series are connected with windings 107 wound in the form of a coil. The windings 107 are welded in the condition of being passed through the lead rods 105, thereby electrically connects a plurality of filaments 106 with the lead rod 105. When attaching the reflecting mirror to the halogen lamp 100 having a structure shown in FIG. 9 and using this halogen lamp 10, there has been a problem that the light emitted from the filament 106 is shut off by the lead rod 105, so that lack of uniformity of luminous intensity distribution are caused.

The object of the invention is to provide a lamp capable of suppressing lack of uniformity of luminous intensity distribution.

The present invention is characterized in that the plurality of filaments is arranged around said lead rod. When arranging a plurality of filaments around the lead rod, the light emitted from the filaments is irradiated approximately uniformly toward the surroundings of the lamp without being shut off by the lead rod, whereby lack of uniformity of luminous intensity distribution can be suppressed.

Here, the lamp according to the invention preferably comprises a plurality of filament structure elements, each of the filament structure elements having the plurality of filament, and the lamp comprises a plurality of the lead rod, wherein one of the plurality of the lead rod connects each of the plurality of filament structure elements. Vibration resistance of a lamp can be improved by connecting each of a plurality of the filament structure elements to the one lead rod.

BRIEF DESCRIPTION OF THE DRAWINGS

Embodiments according to the invention will be described below, in which.

DETAILED DESCRIPTION OF THE PREFERRED EMBODIMENTS

Figure 1:
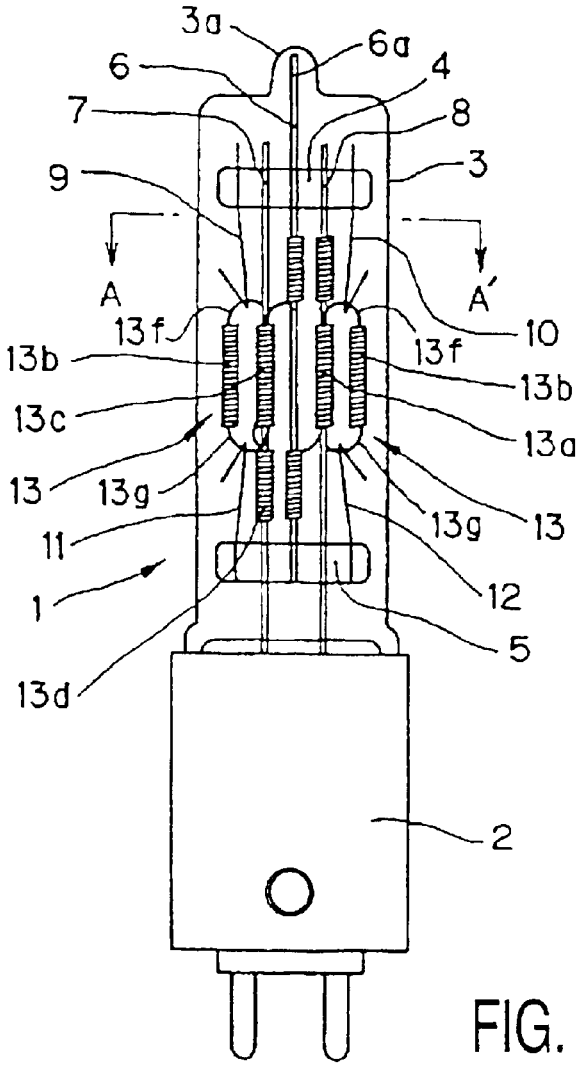
FIG. 1 is a view showing a lamp of a first embodiment according to this invention.
Figure 2:
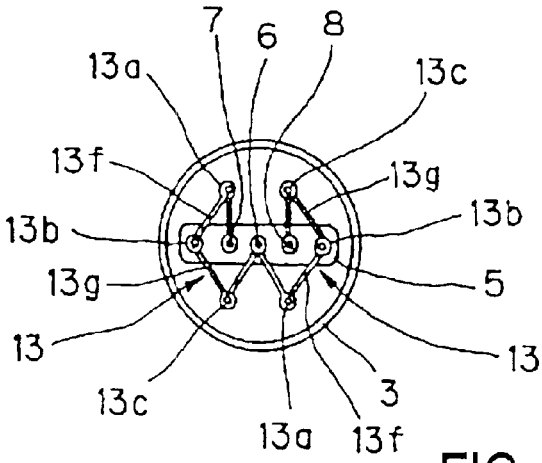
FIG. 2 is a sectional view of FIG. 1, the FIG. 1 being viewed from a direction of line A–A'.

FIG. 1 is a view showing a lamp of a first embodiment according to this invention, and FIG. 2 is a sectional view of FIG. 1 being viewed from a direction of line A–A'. This lamp 1 comprises the base 2 and the glass tube 3 is provided on the upper of this base 2. The base 2 is attached to one end of the glass tube 3 and a small-diameter tube 3*a* is formed at a center of the other end of this glass tube 3. Moreover, a stem (refer to FIG. 3 and FIG. 4 which will be described below) constituted by parts such as three pieces of lead rod 6, 7 and 8 is provided, and furthermore, two pieces of filament structure elements 13 (refer to FIG. 5) are provided on the inside of the glass tube 3 as shown in FIG. 2. Each of two pieces of filament structure elements 13 has three pieces of filament 13*a*, 13*b* and 13*c*. Since a piece of filament structure element 13 has three pieces of filament 13*a*, 13*b* and 13*c*, six pieces of filament 13*a*, 13*b* and 13*c* in total are arranged within the glass tube 3. Therefore, this lamp 1 is the lamp having six sections of filament structure. These six pieces of filament 13*a*, 13*b* and 13*c* are arranged in a manner to surround three pieces of lead rod 6, 7 and 8. Moreover, in FIG. 1, two filaments of three filaments provided for each of filament structure elements 13 are illustrated, and one remaining filament is not shown since the remaining filament hides behind the back of the lead rod 7 and 8.

Figure 3:
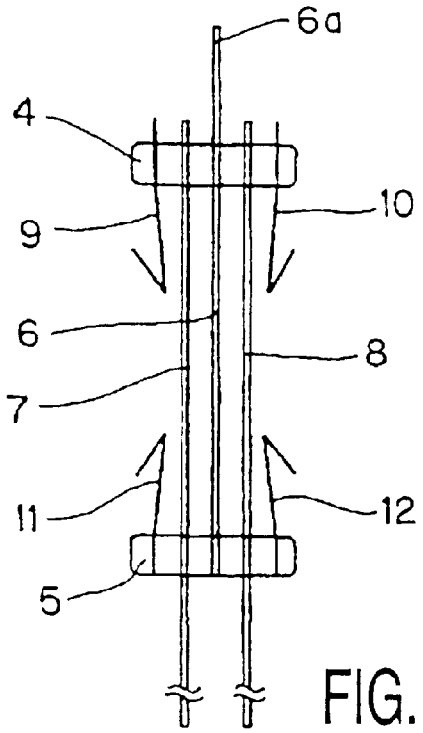
FIG. 3 is a front elevation showing a stem.
Figure 4:
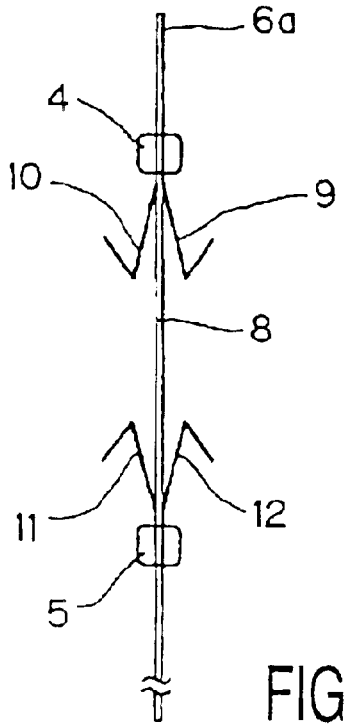
FIG. 4 is a side elevation of the stem shown in FIG. 3, the stem being viewed from the right side.

FIG. 3 is a front view of a stem, and FIG. 4 is a side view of the stem shown in FIG. 3, the stem being viewed from the right side. The stem is constituted by two pieces of the glass pieces 4 and 5, three pieces of the lead rod 6, 7 and 8, and four pieces of support 9, 10, 11 and 12. Three pieces of the lead rod 6, 7 and 8 are fixed by two pieces of glass piece 4 and 5. The centered lead rod 6 of these three pieces of lead rod 6, 7 and 8 is fixed so as to project to the upper slightly than other lead rods 7 and 8. Moreover, two supports 9 and 10 are attached to the glass piece 4 and two supports 11 and 12 are attached to the other glass piece 5. The supports 9 and 11 (which are attached to the left of the glass pieces 4 and 5) of these four pieces of support 9, 10, 11 and 12 are protruded to the opposite side each other with respect to the lead rod 8 as shown in FIG. 4. Moreover, the supports 10 and 12 attached to the right of the glass pieces 4 and 5 are also protruded to the opposite side each other with respect to the lead rod 8 as shown in FIG. 4. Moreover, two pieces of the lead rod 7 and 8 of three pieces of the lead rod 6, 7 and 8 are connected with the base 2, and the remaining lead rod 6 is for connecting two pieces of filament structure element 13 each other. Two pieces of filament structure elements 13 are attached to the stem composed as described above.

Figure 5:
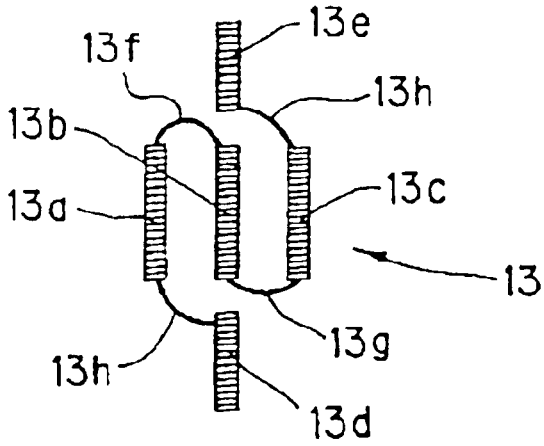
FIG. 5 is a view showing a filament structure.

FIG. 5 is a view showing a filament structure element. As shown in FIG. 5, the filament structure element 13 comprises three pieces of filament 13*a*, 13*b*, and 13*c* and two windings 13*d* and 13*e* wound in the form of a coil. Three filaments 13*a*, 13*b* and 13*c* are connected each other in series by connecting wires 13*f* and 13*g*. Windings 13*d* and 13*e* are connected to the filaments 13*a* and 13*c* by a connecting wire 13*h*. This filament structure element 13 is formed by coiling a piece of tungsten single wire such that three pieces of filament 13*a*, 13*b* and 13*c* and two windings 13*d* and 13*e* are formed. Two pieces of filament structure elements 13 having such structure are fixed between the glass pieces 4 and 5. One filament structure element 13 of two filament structure elements 13 is fixed to the side of the lead rod 8 with respect to the centered lead rod 6 (refer to FIG. 2), and the other filament 13 is fixed to the side of the lead rod 7. How to fix two pieces of filament structure elements 13 between the glass pieces 4 and 5 will be described below.

Figure 6:
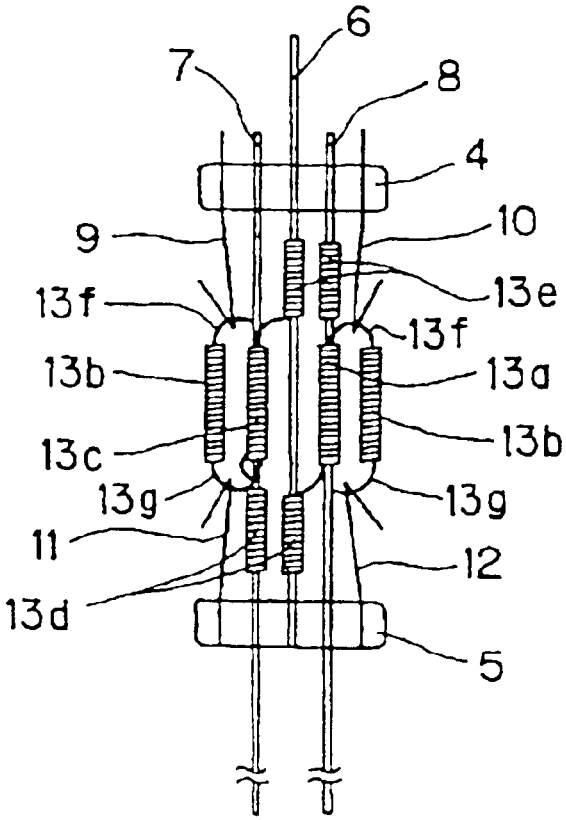
FIG. 6 is a front elevation showing a condition which two pieces of filament structure elements 13 are fixed to the stem.
Figure 7:
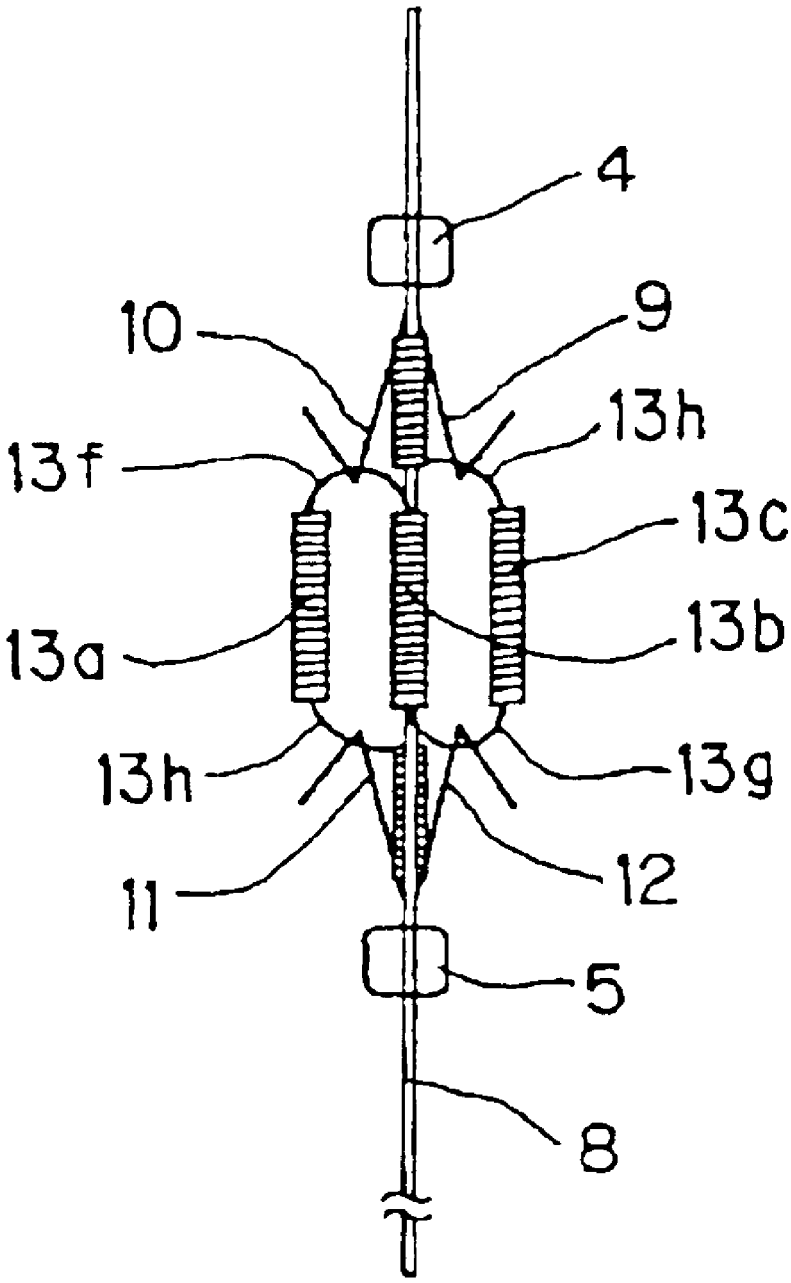
FIG. 7 is a side elevation of the stem, the stem being viewed from the side of the filament structure element 13 fixed to the side of the lead rod 8.

FIG. 6 is a front elevation showing a condition which two pieces of filament structure elements 13 are fixed to the stem. FIG. 7 is a side elevation of this stem, the stem being viewed from the side of the filament structure element 13 fixed to the side of the lead rod 8. In the filament structure element 13 fixed to the side of the lead rod 8, the bottom side winding 13*d* of the windings 13*d* and 13*e* is welded in the condition of being passed through the centered lead rod 6 of three pieces of lead rod 6, 7 and 8, and the upper side winding 13*e* is welded in the condition of being passed through the right side lead rod 8. Furthermore, with respect to the connecting wires 13*f* and 13*g* connecting three filaments 13*a*, 13*b* and 13*c* in series, the one connecting wires 13*f* connecting the filaments 13*a* and 13*b* is hooked to the support 10 (refer to FIG. 4) attached to the glass piece 4, and the other connecting wire 13*g* is hooked to the support 12 (refer to FIG. 4) attached to the glass piece 5.

As shown in FIG. 7, these support 10 and 12 are protruded to the opposite side each other with respect to the lead rod 8. Therefore, when each of the connecting wires 13*f* and 13*g* connecting three filaments 13*a*, 13*b* and 13*c* is hooked to each of the support 10 and 12 as mentioned above, these three filaments 13*a*, 13*b* and 13*c* are attached in the condition that the filaments 13*a* and 13*c* are arranged on both sides of the filaments 13*b*. At this point of time, as shown in FIG. 2, these three filaments 13*a*, 13*b* and 13*c* are arranged so as to surround the lead rod 8 from a direction of 180 degree. On the one hand, in the filament structure element 13 fixed to the side of the lead rod 7, the upper side winding 13*e* of the windings 13*d* and 13*e* is welded in the condition of being passed through the centered lead rod 6 of three pieces of lead rod 6, 7 and 8, and the bottom side winding 13*d* is welded in the condition of being passed through the left side lead rod 7. Furthermore, with respect to the connecting wires 13*f* and 13*g*, the one connecting wires 13*f* connecting the filaments 13*a* and 13*b* is hooked to the support 9 (refer to FIG. 4) attached to the glass piece 4, and the other connecting wire 13*g* is hooked to the support 11 (refer to FIG. 4) attached to the glass piece 5. As shown in FIG. 7, these support 9 and 11 are protruded to the opposite side each other with respect to the lead rod 6. Therefore, when each of the connecting wires 13*f* and 13*g* connecting three filaments 13*a*, 13*b* and 13*c* is hooked to each of the support 9 and 11 as mentioned above, these three filaments 13*a*, 13*b* and 13*c* are attached so as to surround the lead rod 7 from a direction of 180 degree in the condition that the filaments 13*a* and 13*c* are arranged on both sides of the filaments 13*b*, as shown in FIG. 2. Therefore, as shown in FIG. 2, the filaments 13*a*, 13*b* and 13*c* provided for each of two filament structure elements 13 are arranged so as to surround three pieces of lead rod from a direction of 360 degrees. Moreover, two pieces of filament structure elements 13 are connected each other in series by the lead rod 6. In the lamp constituted as described above, the filaments 13*a*, 13*b* and 13*c* are arranged outside the lead rod 6, 7 and 8, and no other member exists between the filaments 13*a*, 13*b* and 13*c* and the glass tube 3. Therefore, the light emitted from the filaments 13*a*, 13*b* and 13*c* is irradiated uniformly without being shut off by other members, whereby lack of uniformity of luminous intensity distribution can be suppressed. Moreover, as shown in FIG. 1, the stem provided with the filament structure element 13 is arranged in the glass tube 3 in the condition that a tip portion 6*a* of the lead rod 6 is inserted into the small-diameter tube 3*a*. In the case that the small-diameter tube 3*a* is formed on the glass tube 3 in advance as described above, this small-diameter tube 3*a* serves as a mark for positioning the tip portion 6*a* of the lead rod 6 when arranging the stem in the glass tube 3, whereby positioning of various parts such as the filament can be performed accurately. Moreover, two pieces of the filament structure element 13 having three pieces of filament 13*a*, 13*b* and 13*c* are provided in order to form the lamp of the filament structure having six sections in this embodiment, and these filament structure elements 13 are connected by the lead rod 6. As described above, when separate filament structure elements 13 are connected by the lead rod 6 to form the lamp of the filament structure having six sections, vibration resistance of a lamp can be improved as compared with the lamp of the filament structure having six sections constituted by providing a piece of filament structure element with six filaments.

Figure 8:
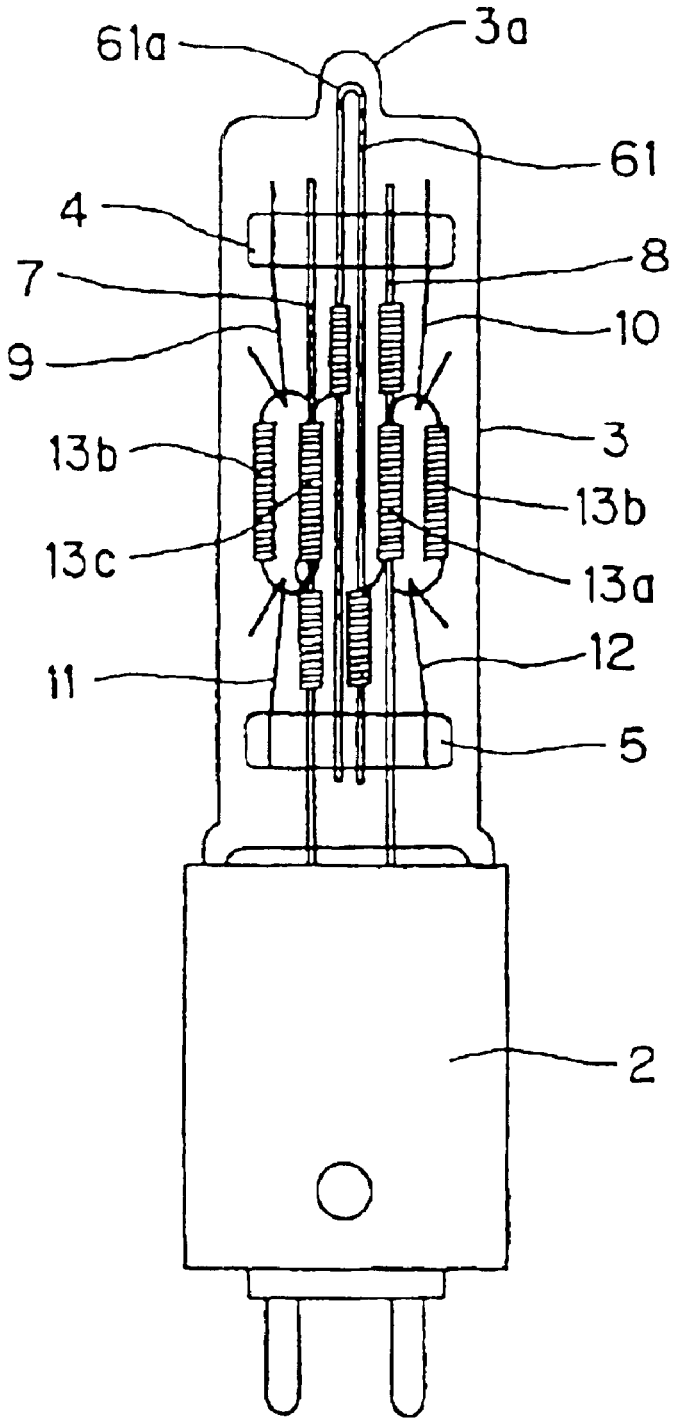
FIG. 8 is a view showing a lamp of a second embodiment according to this invention.
Figure 9:
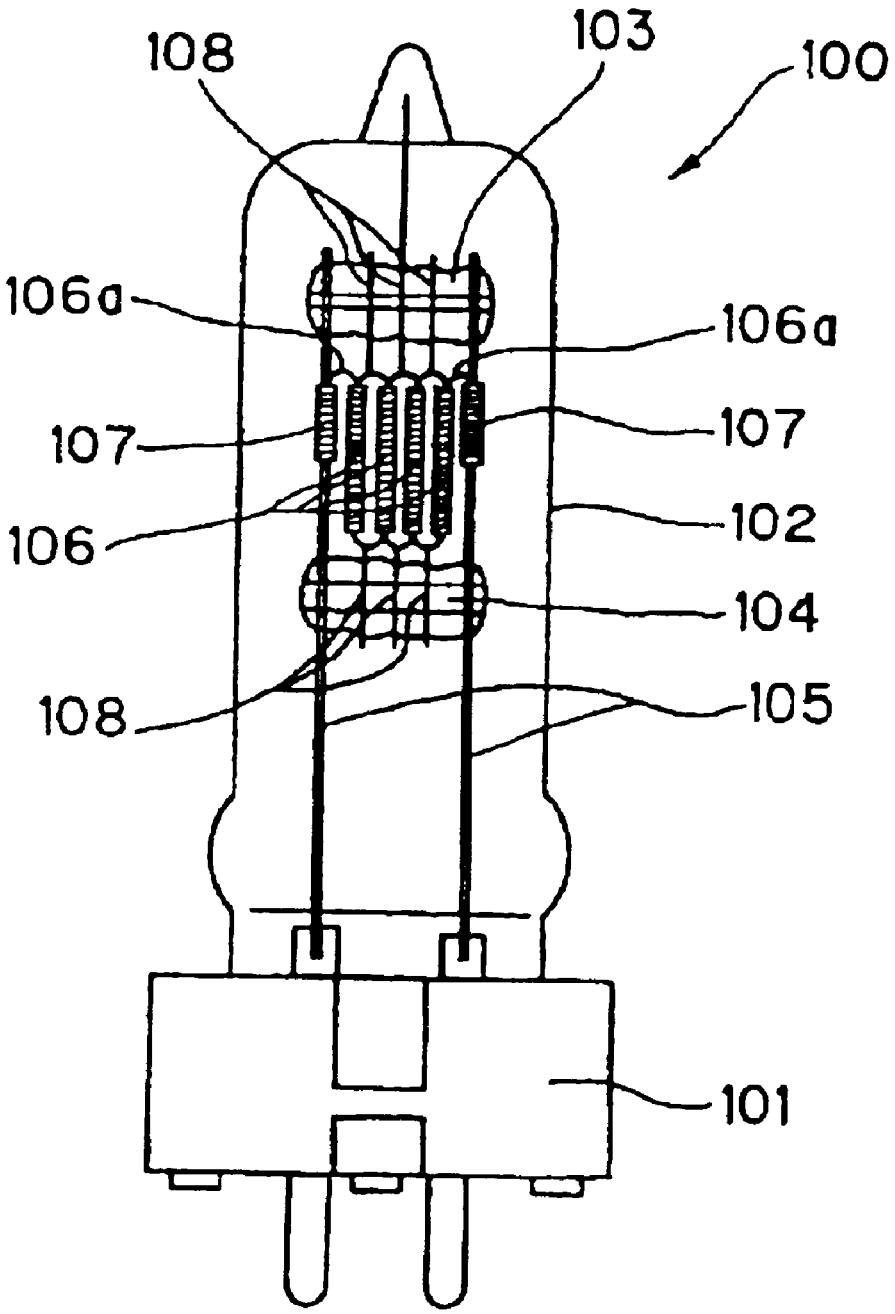
FIG. 9 (PRIOR ART)
FIG. 9 is a view showing a conventional example of a halogen lamp for the studio.

FIG. 8 is a view showing a lamp of a second embodiment according to this invention. Moreover, in the following description of the lamp of the second embodiment shown in FIG. 8, those components identical with those of the lamp of first embodiment shown in FIG. 1 are indicated by the same reference numerals, respectively, and only those points different from the lamp of the first embodiment shown in FIG. 1 will be described. The difference between the lamp in the second embodiment shown in FIG. 8 and the lamp in the first embodiment shown in FIG. 1 is that all three pieces of lead rod 6, 7 and 8 are rodlike in the lamp shown in FIG. 1, whereas a centered lead rod 61 of three pieces of lead rod 7, 8 and 61 has a form of U-shape in the lamp shown in FIG. 8. This lead rod 61 is arranged such that a bent portion 61*a* is inserted into the small-diameter tube 3*a*. As described above, this invention should not be mentioned for a form of a lead rod, and the filaments are arranged outside the lead rods, whereby the light emitted from the filaments is irradiated uniformly, and lack of uniformity of luminous intensity distribution can be suppressed. Moreover, although the lamp having six filaments has been described in the first embodiment and the second embodiment, the number of filament should not be limited to six pieces in this invention. With respect to lamp which needs a plurality of filaments (for example, four pieces), what the plurality of filaments are arranged around the lead rod can suppress lack of uniformity of luminous intensity distribution. Moreover, although the filaments 13*a*, 13*b* and 13*c* are single windings in the first embodiment and the second embodiment, these may be non-windings, or may be duplex windings.

What is claimed is:

1. A lamp comprising at least one lead rod and a plurality of filaments, wherein the plurality of filaments is arranged around the lead rod so that each lead rod has two filaments located on essentially diametrically opposite sides thereof and wherein groups of three filaments are arranged so that each of the three filaments is located at a point of a triangle which lies on a plane which is normal to and intersective with the lead rod.

2. A lamp as claimed in claim 1, wherein the lamp comprises a plurality of filament structure elements, each of the filament structure elements having the plurality of filaments, and wherein the lamp comprises a plurality of the lead rods, wherein one of the plurality of the lead rods is connected to each of the plurality of filament structure elements.

3. A lamp as claimed in claim 1, wherein at least a predetermined number of the plurality of filaments are serially connected.

4. A lamp as claimed in claim 3, further comprising a plurality of support wires which have hook portions which each hook a portion of a single wire from which the predetermined number of serially connected filaments are formed and which is between two of the serially connected filaments.

5. A lamp as claimed in claim 2, further comprising windings which are wound from a single wire from which the predetermined number of serially connected filaments are formed, and which are located at each end of the single wire.

6. A lamp as claimed in claim 1, comprising a single wire, the single wire being wound at a number of locations to form a number of the serially connected filaments and further wound to form a winding at each end.

7. A lamp as claimed in claim 6, wherein the winding at each end of the single wire from which serially connected filaments are formed, is axially displaced with respect to the serially connected filaments, so that each winding is located closer to a glass piece that connects the lead rods than the serially connected filaments.

* * * * *